US005816028A

United States Patent [19]

Zaniboni

[11] Patent Number: 5,816,028

[45] Date of Patent: Oct. 6, 1998

[54] COMPACT DISC PACKAGING MACHINE

[75] Inventor: Carlo Zaniboni, Castenaso, Italy

[73] Assignee: Gima S.p.A., Zola Predosa, Italy

[21] Appl. No.: 662,971

[22] Filed: Jun. 13, 1996

Related U.S. Application Data

[60] Provisional application No. 60/000,222, Jun. 14, 1995.

[51] Int. Cl. [6] ..... B65B 35/54

[52] U.S. Cl. ..... 53/445; 53/55; 53/117; 53/157; 53/168; 53/429; 53/468; 53/474; 53/493; 53/238; 53/284.5

[58] Field of Search ..... 53/55, 117, 168, 53/173, 155, 156, 157, 238, 266.1, 284.5, 281, 429, 445, 449, 452, 458, 467, 468, 471, 474, 499, 566

[56] References Cited

U.S. PATENT DOCUMENTS

| | | | |
|---|---|---|---|
| 4,201,027 | 5/1980 | Ilsemann | 53/266.1 |
| 4,297,826 | 11/1981 | Woertche . | |
| 4,523,422 | 6/1985 | Ilsemann . | |
| 4,594,837 | 6/1986 | Zielke | 53/468 |
| 4,685,277 | 8/1987 | Ilsemann | 53/238 X |
| 4,852,327 | 8/1989 | Kurkowski et al. . | |
| 5,163,271 | 11/1992 | Pan et al. . | |
| 5,207,050 | 5/1993 | Fulkerson et al. . | |
| 5,285,620 | 2/1994 | Kaye et al. . | |
| 5,341,624 | 8/1994 | Kaye . | |
| 5,561,962 | 10/1996 | Everhard et al. | 53/55 |

OTHER PUBLICATIONS

Advertisement by Automated Systems, Inc. for CD packaging machines (undated).

*Primary Examiner*—Daniel Moon
*Attorney, Agent, or Firm*—James Creighton Wray; Meera P. Narasimhan

[57] ABSTRACT

A compact disc packaging machine is disclosed for packaging trays, compact discs, booklets and inlay cards in a variety of different sized containers. The compact disc machine is compact in size and its primary functions are mechanically driven. Pneumatics are only used on approximately 10 percent of the machine functions. Because the components are within the easy reach of an operator, the compact disc packaging machine is operated without requiring the operator to circle the machine. Feeders and magazines provide supplies of trays, booklets, inlay cards and compact discs to the machine. The compact disc magazine uses multiple spindles to allow one spindle to be active while the other spindle is replaced. A pick-and-place mechanism lifts the inlay cards, booklets, trays and compact discs and positions them in an intermediate centering positions and then into compact disc boxes. Sensors are used to verify the existence and placement of those items in the boxes. The compact disc packaging machine of the present invention provides a reliable and easy to operate machine, minimizes down-time and is especially suited for small replicators and companies who are entering into the compact disc market.

50 Claims, 4 Drawing Sheets

FIG. 6
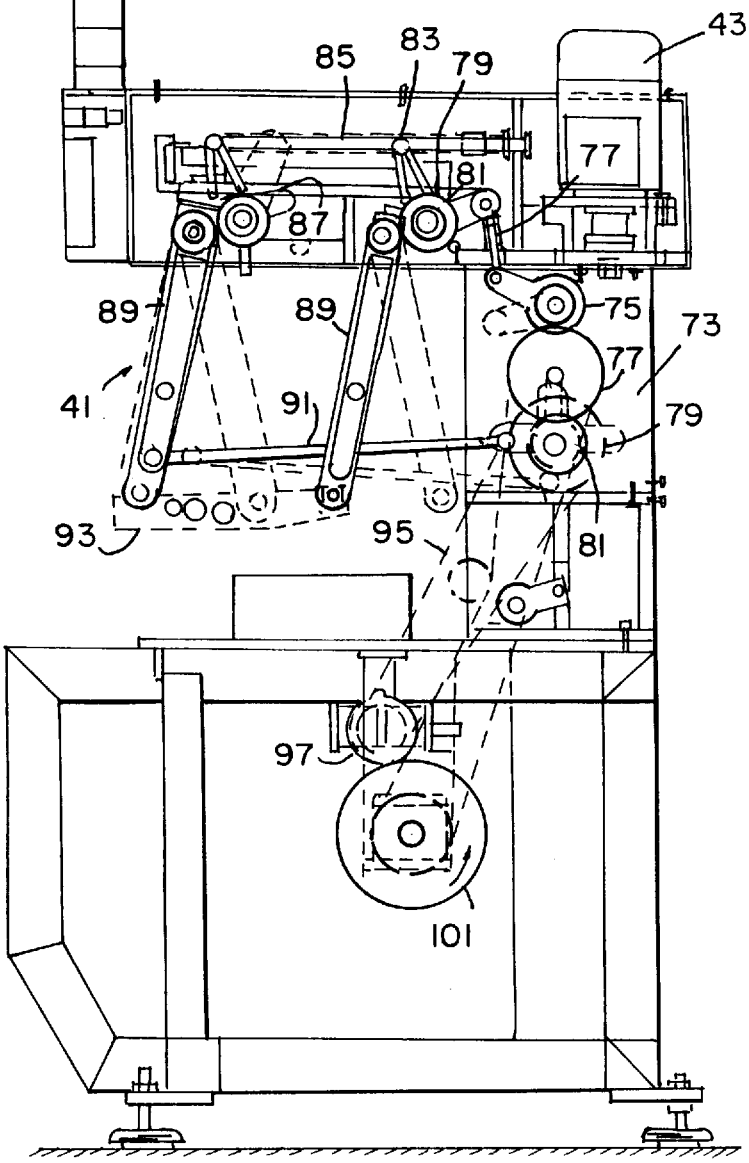
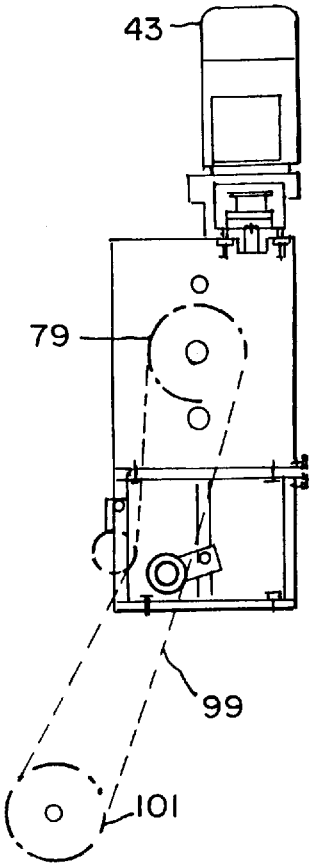
FIG. 7

COMPACT DISC PACKAGING MACHINE

BACKGROUND OF THE INVENTION

This application claims the benefit of U.S. Provisional application No. 60/000,222, filed Jun. 14, 1995 now abandoned.

The present invention relates to compact disc packaging machines.

Small scale replicators and small volume companies entering the compact disc packaging market generally encounter production difficulties not realized by larger mass packaging companies. Needs exist for compact disc packaging machines that require minimal readjustment and that provide for extended, uninterrupted periods of production. Many existing compact disc packaging machines are electro pneumatic machines that require re-adjustment for changes in compressed air pressure and machine operating temperature. Those re-adjustments are time-consuming and costly. Downtime must be kept to a minimum, especially for replicators who do not run the standard Jewel box configuration on continuous twenty-four hour schedules.

Existing prior art compact disc packaging machines are large and difficult to operate. Access points are not conveniently located to allow one-side operation. Needs exist for compact disc packaging machines that are compact and easy to operate.

Needs exist for compact disc packaging machines that are compact, reliable, and easy to operate.

SUMMARY OF THE INVENTION

The present invention provides a compact and productive compact disc packaging machine that fits a distributed manufacturing philosophy. The present invention is the ideal solution for small replicators and companies who are entering into the compact disc packaging industry.

The present compact disc packaging machine overcomes limitations found in existing machines. Because the present invention is mechanically driven, the packaging machine is more reliable and trouble-free than competing electro pneumatic machines which require re-adjustment for changes in compressed air pressure and machine operating temperature. That is extremely important to replicators who do not run the standard Jewel box configuration on a twenty-four hour continuous basis.

The present invention is characterized by great reliability in operation and extreme simplicity in use. Those characteristics are extremely important to all users, but particularly to those replicators who do not operate on a continuous basis or do not have specially trained operators. The mechanical drive design of the present invention allows a cold start-up without downtime or initial rejections due to the need for machine re-adjustments. To obtain a high level of reliability, the present invention is devised such that all primary functions are performed by over-sized, mechanically driven actuators. Pneumatics are only used on approximately 10% of the machine functions and only for secondary considerations. Low maintenance costs are realized due to a minimum of wear points and the use of a sealed kinematics box with a lifetime guarantee. The compact design of the present machine minimizes floor space and results in overall dimensions of only 1.5 meters by 2.0 meters. The electrical panel is built into the base of the machine. The machine is delivered fully assembled, thereby eliminating assembly problems and providing for immediate customer use.

The present compact disc packaging machine is easy to operate. All components are within reach, thereby obviating the need to circle the machine to load, unload and operate the machine. The modular construction of the present invention is aimed at achieving easy field installation of alternate box options and future upgrade modules. The alternative box options of the present invention allow for the packaging of Brilliant, Double Slim, Two Piece or MultiPack boxes. Upgrade modules may be added to the present invention to increase the infeed autonomy of boxes, trays and discs.

The present machine provides for a high level of performance at an attractive price. That result is achieved through a dramatic reduction in the number of moving parts in the machine. The efficient use of electronics and software gives a user an important tool for providing user friendly diagnostic messages, for gathering production data and for providing documentation of the machine performance.

In the present invention indexing drives and an overhead swing frame allow the compact disc packaging machine to perform all of its functions from one mechanical movement source. The present invention performs the complete functions all from a single source, with high speed but low cost. The present machine has one motor, one cam, and one follower, which drives T-shaped bell cranks to lift and lower the overhead swing frame with four interconnected vertical support swing arms. All four of the pick and place arms are connected. The single mechanical source also drives the swing frame back and forth. Gears horizontally drive the pick and place parallel swing arms. Gears and timing belts drive the unstacking, indexing, closing and accumulating functions.

Parallel bell cranks rotate on fixed axes in the head of the machine. The cam follower through links reciprocates the head bell cranks. The swing arms have upper pivots connected to ends of the bell cranks to lift and lower the swing axes. A long generally horizontal link near a lower end of an outer swing arm moves the swing frame with a crank. Lower ends of the swing frame carry the pick and place arms. The upper bell cranks lift and lower the swing arms, while the crank moves the swing arm outward and inward in proper sequence.

One bell crank oscillates a link which in turn drives a one-way clutch. An inner bell crank arm drives an oscillating shaft through a link and crank. The oscillating shaft operates the one-way clutch, gears and a secondary crank.

The cam, links, cranks, gears and arms are in the machine head. A timing belt connects an idler gear to a main drive gear for the main indexing shaft on the machine base, which drives the indexing mechanism. A second timing belt connects a lower gear to a second indexing drive. A third timing belt controls the unstacking.

The pick and place swing arm heads use vacuum lifts to first move elements from tops of stacks to intermediate locations, and then to move the elements from those locations to the index stations. A first station unloads containers (Jewel boxes) from a bottom of a stack and opens the boxes. A second station unstacks, folds, and inserts liner inlay cards from one side and loads booklets in the other side of the container. A third station senses the correct loading and positions of the inlay cards and booklets. A fourth station loads trays into the container. A fifth station loads discs onto the trays. A sixth station closes the container containing the disc and tray. A seventh station rotates the closed container upright and pushes the closed container into a horizontal stack on an accumulator. The accumulator steps assembled stacks forward for removal and packing.

Two disc-holding spindles are mounted on a turret so that one spindle may be loaded while the machine picks discs from the other spindle. The compact disc Jewel boxes are transported by means of two cleated timing belts which precisely and reliably move the boxes between stations. The timing belts are indexed by an intermittent mechanical drive system, which positively moves the boxes with drive cleats, rather than by friction, against a moving conveyor belt.

The packaging machine operations of the present invention are carried out by multiple machine stations.

The first station is the Box Infeeding and Opening Station. In the first station, the boxes are manually loaded into a vertical magazine. Sensors check the orientation of each box in the magazine. The box pickup head indexes a box from the bottom of the infeed stack and immediately rotates the cover 180 degrees to a full open position.

The second station is the Inlay Card and Booklet Station. In this station, both inlay card insertion and booklet insertion are accomplished within the same machine cycle. The inlay card is picked up from a vertical stack, transferred into an intermediate pre-folding and locating fixture, and then inserted into the box base. The booklet magazine includes an indexing conveyor where the booklets are placed in a fanned horizontal position by the operator. A vacuum pickup head lifts the booklet from the belt, transfers it to an intermediate centering fixture, and then inserts the booklet into the open box cover.

The third station is the Control Station. Sensors in the Control Station verify both the presence and the correct positioning of the inlay card and booklet.

The fourth station is the Tray Insert Station. Trays having rosettes for holding compact discs are manually loaded into a vertical magazine. Standard versions of the present invention include magazines capable of holding 250 trays. A tray pick-up head indexes a tray from the bottom of the stack using a mechanism which avoids scratching the tray, and places the tray first into an intermediate centering fixture and then into the box. Sensors verify both the presence and the correct insertion of the tray into the box.

The fifth station is the Compact Disc Insertion Station. The compact disc infeed includes a two-position rotary table on which spindles of discs are manually placed. While the machine is infeeding discs from the spindle in the "infeed position," the rotary table allows an empty spindle to be removed and replaced with a full spindle. Most existing types of spindles, up to 35 mm in height, can be accommodated. The use of plastic spindles is also possible as long as they are rugged enough for industrial use. Discs are picked from the spindle in the infeed position using a dual vacuum pickup head. The discs are positioned on a conical pin in an intermediate fixture to eliminate positioning inaccuracies caused by variations in the verticality of the spindles. As the dual vacuum pickup head places a disc from the spindle onto the conical pin, the pick-up head simultaneously picks the previous disc off the conical pin and places that disc onto the rosette of the tray previously inserted into the box. Sensors verify both the presence and the correct insertion of the disc into the box.

The Sixth station is the Box Closing Station. In this station, the cover is closed.

The Seventh station is the Closed Box Unloading Station. Three methods of operation are available for the seventh station:

(a) A vertical stack with a capacity of 25 pieces is intended for use in gathering QC samples or incomplete assemblies.

(b) A collecting table can hold up to 100 boxes in vertical stacks of 25.

(c) A conveyor outfeed connects to another machine such as an overwrapper.

It is possible to override the box closing function and to outfeed boxes in an open position. That allows the downstream insertion of coupons or special offer cards either manually or with special insertion machines.

The present compact disc packaging machine is easily equipped to package alternative compact disc boxes:

The addition of an external machine group, with no modification or adjustments to the standard machine, enables the present machine to package Brilliant or Double Slimpak boxes. The add-on machine group inserts a second compact disc into the bottom of the tray before the tray is manually inserted into the tray infeed magazine. That machine group is controlled by the controller within the main machine. An additional sensor verifies placement of the bottom disc on the tray.

An additional machine group to feed, fold and insert a "J" card into the box cover in Station No. 5 during disc placement upgrades the machine to handle two piece boxes. That machine group is run by the controller within the main machine. An additional sensor verifies placement of the "J" card. Changeover time is accomplished in minutes.

Based on the packaging requirement of 2, 3 or 4 discs per multipack box, the present machine is readily configured to complete the packaging operation by repeating the operations. It is also possible to link several of the present machines with flip-over devices so that multipack packages are completed in one pass.

This present machine is readily equipped with retractable wheels to allow easy movement of the present invention within the factory.

Technical specifications of one preferred embodiment of the present invention include:

| | |
|---|---|
| Speed of Machine | 45 ppm |
| Line Voltage | 220 V std, other voltages by request |
| Frequency | 60 Hz |
| Installed Power | 2.4 kW (9.7 A) |
| Air Pressure | 87–90 psi |
| Air consumption | 0.5 gallons/sec. |

In preferred embodiments, the present machine includes magazines having the following capacities:

| | |
|---|---|
| Box | 75 pieces |
| Tray | 150 pieces |
| Inlay Cards | 2,000 pieces |
| Booklet Conveyor: | |
| 2 page | 1,500 pieces |
| 4 page | 1,000 pieces |
| 32 page | 220 pieces |

In one preferred embodiment, the compact disc packaging machine is a multi-style compact disc packaging machine that enables the user to effectively and reliably package both MultiPack CD Boxes and standard CD boxes with a minimum of changeover time. A single machine can package up to 4 discs, 2 inlay cards and 2 booklets into each MultiPack CD Box by running the machine as a double pass system.

In a single pass system embodiment of the present machine, two machines are connected by a flip-over conveyor, thereby allowing for the completion of a MultiPack Box in only one passage. The boxes include the following parts: two trays, multiple clear external lids, one midframe, two booklets, two inlay cards, and four compact discs, with two compact discs on the trays and two compact discs on the midframe.

The sequence of the MultiPack Machine Operations is as follows. The first MultiPack Machine includes the following stations:

Station 1: loads and opens boxes;

Station 2: inserts the first inlay card on the first lid and the first compact disc on the midframe;

Station 3: includes controls for verifying the presence and correct positioning cards;

Station 4: inserts the first tray;

Station 5: inserts the booklet and second compact disc on the first tray;

Station 6: closes the box; and

Station 7: exits the box on a conveyor belt extending between the first machine and a second machine A flip-over group rotates the box 180 degrees so that the box reaches the second machine in the correct position.

The Second MultiPack Machine includes the following stations:

Station 1: feeds and opens the box taken from the conveyor belt extending between the first and second machines;

Station 2: inserts the second inlay card on the second lid and the third compact disc on the internal tray.

Station 3: includes controls for verifying the presence and correct positioning of the card;

Station 4: inserts the second tray;

Station 5: inserts the fourth compact disc on the second tray;

Station 6: closes the box; and

Station 7: either exits the box and stacks the box on the collecting table, or exits the box on the conveyor belt connected to the wrapping machine.

The MultiPack Box may also be packaged using only one MultiPack Machine. By running the multibox through the machine twice, the operator is able to complete the boxes using only one machine. The sequence of the operations during the two passages is the same as described for the two machine embodiment, with only the booklet station being inhibited during one of the passages.

Standard boxes are readily packaged using the MultiPack Machine. Two MultiPack machines can function as stand alone units and can also package standard Jewel boxes. With the optional Slim Double Group, the MultiPack machine is configured to package both Brilliant double boxes and SlimLine double boxes, as well as multipack and standard compact disc boxes.

The Slim Double Group configuration for packaging Brilliant double boxes and SlimLine double boxes is retrofitted to one or both machines, depending on the requirements.

A single pass system is easily repositioned into two separate machines so that they can be run independently.

Technical specifications for a preferred embodiment of the MultiPack Machine includes:

| | |
|---|---|
| Speed of Machine | 45 ppm |
| Line Voltage | 220 V std, other voltages by request |
| Frequency | 60 Hz |
| Installed Power | 2.4 kw (9.7 A) |
| Air Pressure | 87–90 psi |
| Air Consumption | 0.5 gallons/sec. |

These and further and other objects and features of the invention are apparent in the disclosure, which includes the above and ongoing written specification, with the drawings.

BRIEF DESCRIPTION OF THE DRAWINGS

FIG. 6 is a schematic end elevation of the machine showing the operation of the pick and place swing arms and beams and the mechanical operation of the machine taken from the outlet end of the machine.

FIG. 7 is a schematic end elevation detail showing the belt drive from the transfer box.

DETAILED DESCRIPTION OF THE DRAWINGS

Figure 1:
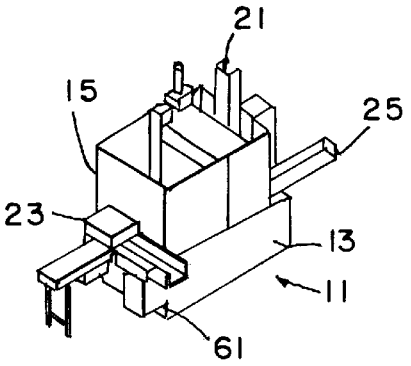
FIG. 1 is a schematic perspective view of the invention taken from the output end and the back of the machine.

As shown in FIGS. 1–4, the machine, which is generally indicated by the numeral 11, has a base 13 and a transparent cover 15. The front 17 of the machine has a compact disc magazine 19 which has plural spindles for loading. A magazine 21 holds stacked Jewel boxes which are opened, loaded and closed, and accumulated at an accumulator 23. Booklets, to be inserted in the boxes, are carried into position by conveyor 25; inlay cards are held in a stack 27; and a magazine of trays 29 is held in the front of the machine for placing in the boxes before the compact discs.

Figure 5:
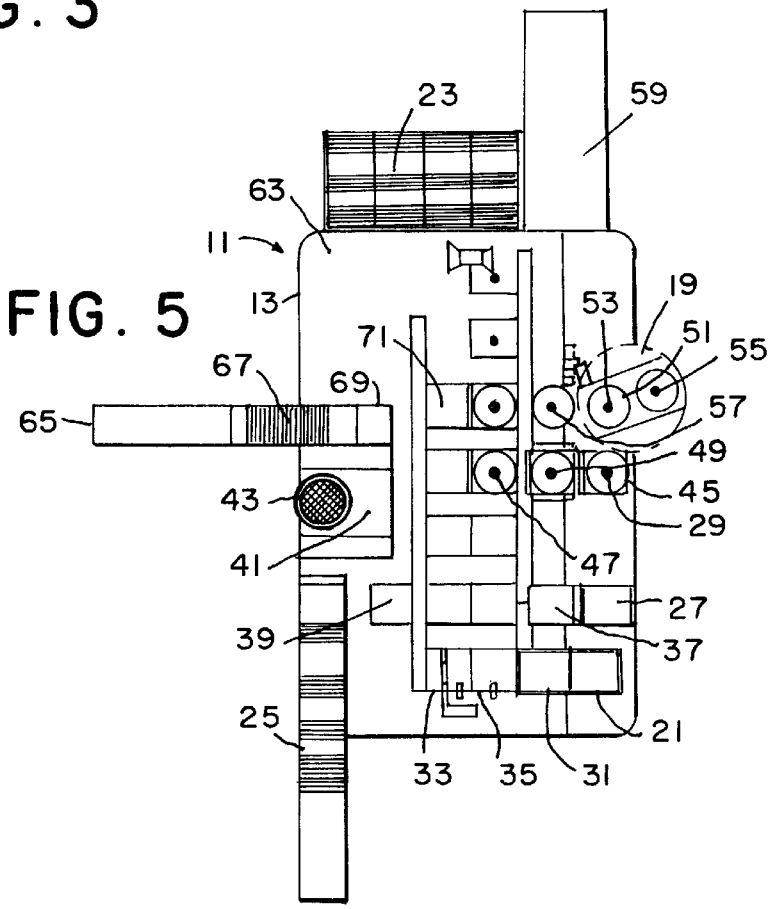
FIG. 5 is a plan view of the table showing the stations of the invention, with the bottom being the inlet end, the top being the outlet end, the right being the operator's side and the left being the back side of the machine.

Stations 1–7 are shown in FIG. 5. In Station 1, the charging and opening station, a box 31 is unstacked from the bottom of the magazine and opened. The box 31 is then moved to the assembly line where the top 33 is rotated 180 degrees outward from the base 35.

In Station 2, the inlay cards are moved into the base 35 of the box 31 and the booklets 39 are moved into the top 33 of the box 31. First, the inlay cards are taken from the stack 27 and are positioned in an intermediate position 37 before they are transferred to the base 35 of the box 31. The booklets 39 are then removed from the booklet feeder 25 and placed in the top 33 of the box 31. The pick and place mechanisms 41 lift and place the booklets 39 and the inlay cards as later will be described. The pick and place mechanisms 41 and the advancing and unstacking mechanisms are operated by a motor 43.

In Station 3, the inlay cards and the booklets 39 are checked for proper positioning in the top 33 and the base 35 of the Jewel box 31.

In Station 4, a tray 45 with a rosette 47 is first moved to an intermediate position 49 for centering the tray 45 and then moved into position into the base 35 of the box 31.

In Station 5, a compact disc 51 is unloaded from an active spindle 53 while the inactive spindle 55 of the turret magazine 19 can be reloaded. The compact disc 51 is moved to an intermediate position 57 for centering and checking before being moved into the box 31 and placed on the rosette 47 on the tray 45.

Figure 2:
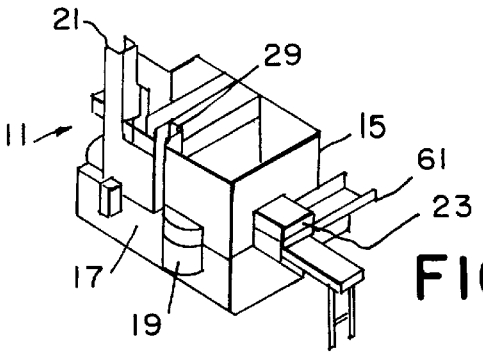
FIG. 2 is a perspective view of the invention taken from the output end and the front or operator's position.
Figure 3:
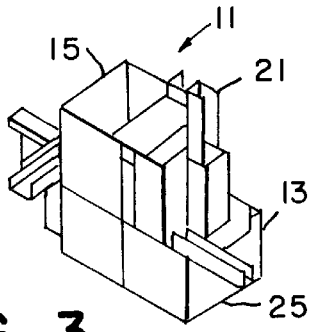
FIG. 3 is a schematic perspective view of the invention taken from the back side of the machine and the inlet end.
Figure 4:
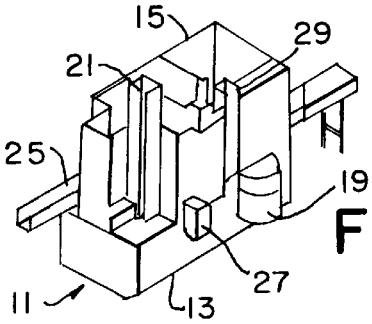
FIG. 4 is a schematic perspective of the invention taken from the operator's side and inlet end of the invention.

In Station 6, the box is closed, and in Station 7, the box is unloaded into a hopper 59, into the accumulator 23, or onto a chute 61 as shown in FIGS. 1 and 2.

A pneumatic plant 63 provides the proper vacuum for lifting the inlay cards, booklets, trays and compact discs. In one form of the invention, a feeder band 65 is provided to feed the stacked covers 67 to an intermediate position 69 where the two-piece feeder 71 connects a cover to a two-piece box base.

Figure 8:
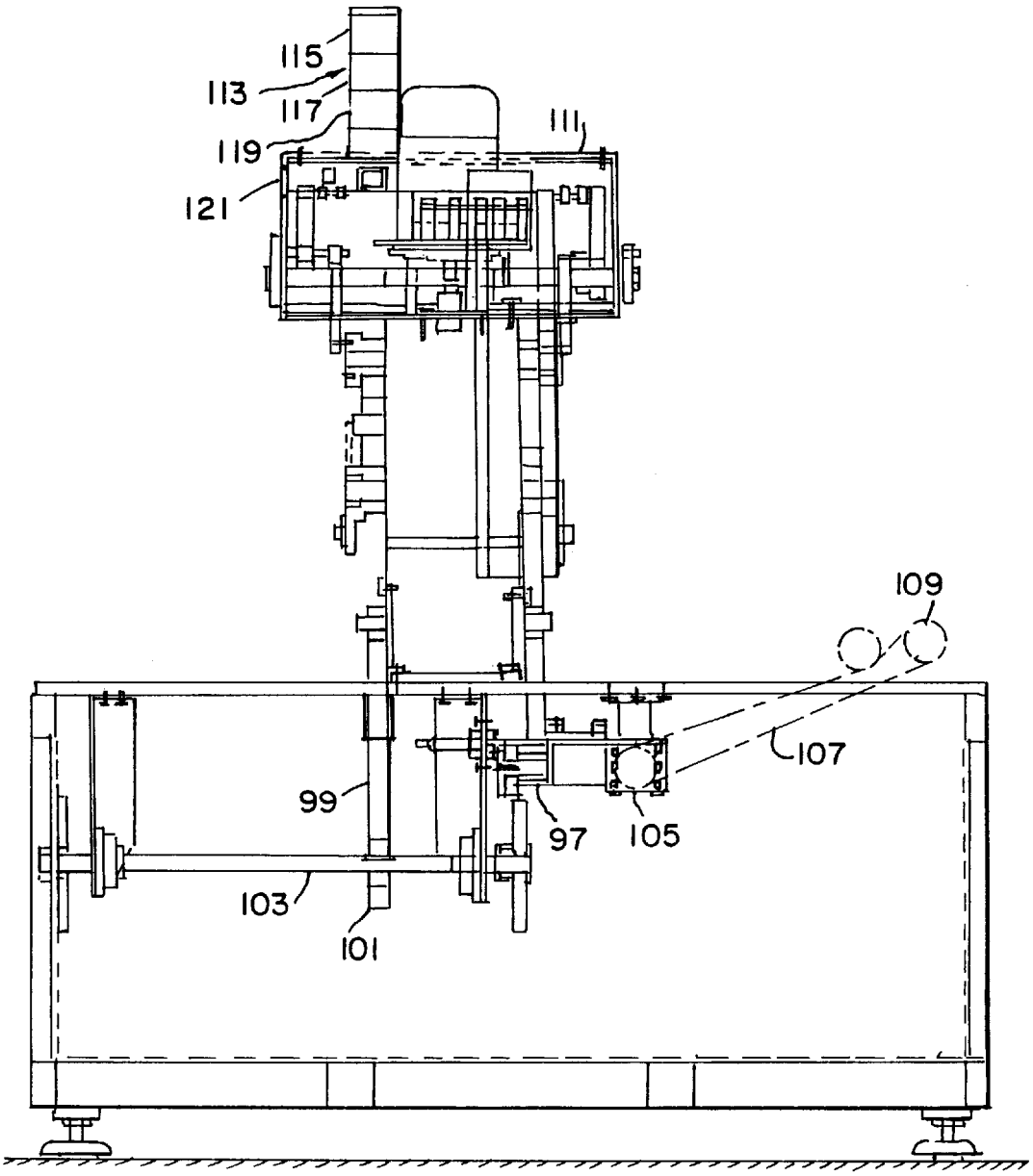
FIG. 8 is a schematic side elevation showing the mechanical drive.
Figure 9:
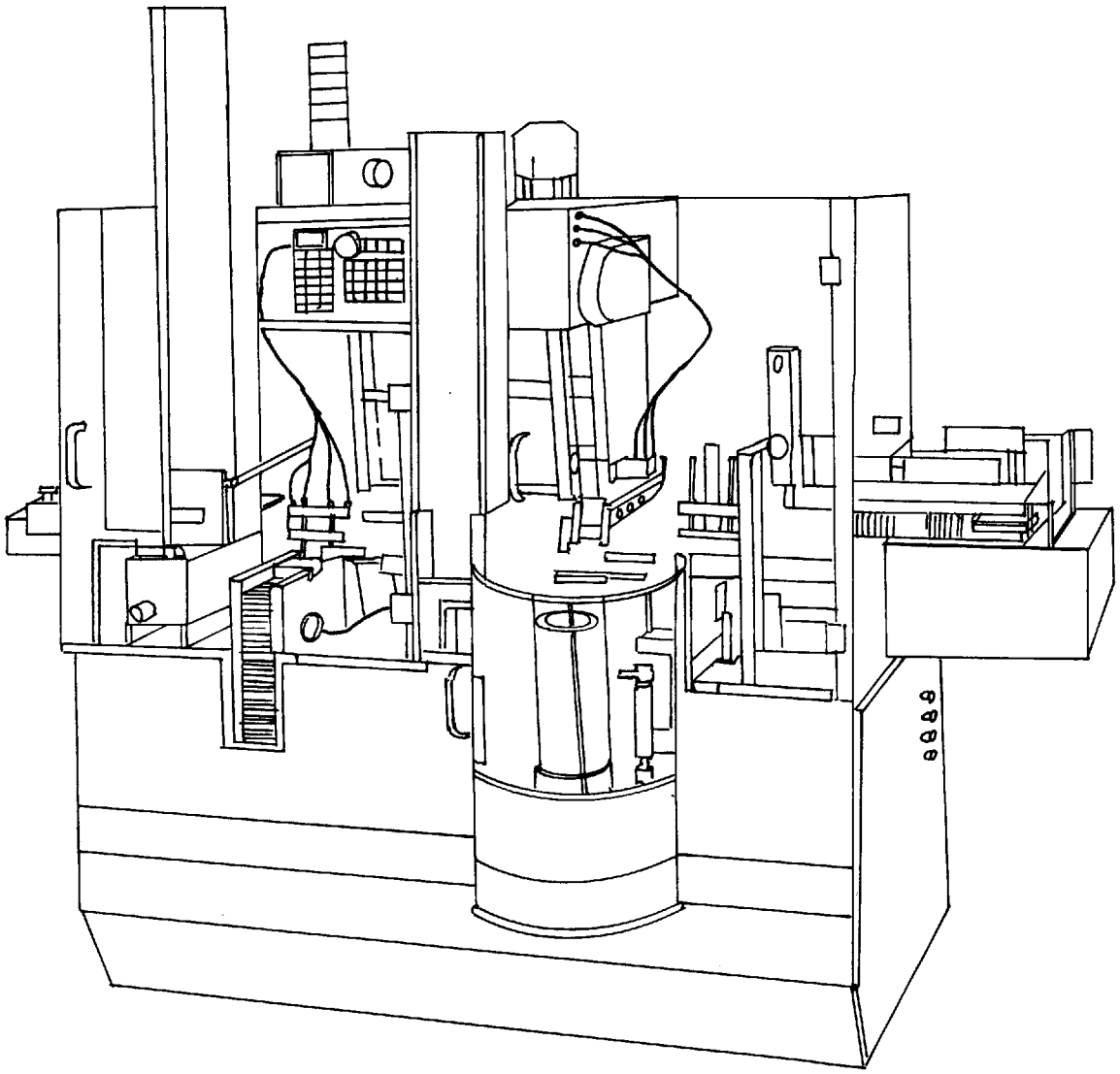
FIG. 9 is a perspective view of the machine taken from the front.

As shown in FIGS. 6, 7, and 8, the motor 43 drives a transmission 73. The transmission has three outputs, an oscillator 75, a pulley 77, and a pulley 79 plus a lever 81. The oscillator 75, which is duplicated on the other side of the transmission, lifts and lowers link 78, which rocks the T-shaped bell crank 79 about shaft 81. The upper end 83 of the T-shaped bell crank 79 drives link 85, which oscillates T-shaped bell crank 87 to lift and lower upper ends 88 of a rocking support 89. Lever 81 drives link 91, as duplicated on the other side of transmission 73, so that two links 91 drive the two outer rocking supports 89. Beams 93 connect the ends 92 of the rocking supports 89. The links 91 move the beams 93 inward and outward while t he link 78 lifts and lowers the beams 93 in proper sequence. The pulley 79 drives the toothed belt 95 which in turn drives the lower pulley 97. Pulley 77, as shown in FIG. 7, drives the toothed belt 99, which in turn drives the lower pulley 101.

As shown in FIG. 8, pulley 101 drives shaft 103 to control the feeder operations. Pulley 97 drives a direction changer 105, which in turn drives tooth belt 107 and pulley 109. At the front, or operator end, of the head enclosure 111 is an indicator lamp 113 with red, yellow, and green glasses 115, 117, and 119. The indicator lamp 113 indicates the status of operation. Just below the indicator lamp 113 is a control panel 121.

The pulleys 97 and 101 drive the indexing operations which move the boxes into the machine direction and which unstack the boxes, inlay cards, and trays. The swinging arm and the beams lift the booklets and inlay cards to intermediate centering devices and then lift the inlet cards and booklets into the opened box. The vacuum heads also lift the trays from an intermediate centering position to the box, and lift the compact discs from the working position to an intermediate centering pin and then to the rosette of the tray installed in the box.

The compact discs are preferably fed from the needle to the pin with pneumatic cylinder-driven pushers.

The booklet infeeder may be a motor-driven belt which brings the booklet to the booklet transfer location to be placed upon the intermediate centering device.

While the invention has been described with reference to specific embodiments, modifications and variations of the invention may be constructed without departing from the scope of the invention, which is defined in the following claims.

We claim:

1. A compact disc packaging machine comprising a compact disc box magazine for holding and supplying empty compact disc boxes, a box pick-up head for moving the empty compact disc boxes, a box opener for opening the boxes, an inlay card holder for holding and supplying inlay cards prior to their insertion into the boxes, a booklet feeder for holding and supplying booklets prior to their insertion into the boxes, a compact disc tray magazine for holding and supplying trays to be placed into the boxes, a magazine for holding and supplying compact discs, an advancing mechanism for indexing the compact disc boxes, a pick-and-place mechanism for lifting inlay cards, booklets, trays, and compact discs, a motor for operating the pick-and-place mechanism, intermediate centering positions for positioning items prior to their assembly, multiple sensors for checking the presence and the correct positioning of assembled items, a panel for controlling the compact disc packaging machine, and a stacker for removing packaged compact disc boxes and plural mechanically operable actuators for operating the machine.

2. The compact disc packaging machine of claim 1, wherein the pick-and-place pick-up head further comprises a pneumatic lines for providing vacuum for moving the inlay cards, booklets, trays and compact discs.

3. The compact disc packaging machine of claim 1, further comprising a compact disc box cover opener for rotating a closed compact disc box cover 180 degrees to a full open position and further comprising a compact disc box cover closer for rotating the compact disc box cover 180 degrees to a closed position.

4. The compact disc packaging machine of claim 1, wherein the booklet feeder is a motor-driven belt for bringing a booklet to a booklet transfer location where the booklet is placed upon the at least one intermediate centering device.

5. The compact disc packaging machine of claim 1, where in the multiple sensors further comprise a first sensor for checking the presence and the correct positioning of assembled inlay cards, a second sensor for checking the presence and the correct positioning of assembled booklets, a third sensor for checking the presence and the correct insertion of assembled compact discs, and a fourth sensor for checking the presence and the correct insertion of a compact disc tray.

6. The compact disc packaging machine of claim 1, further comprising a base and a cover and wherein the panel is an electric panel built into the base of the machine.

7. The compact disc packaging machine of claim 6, wherein the base further comprises retractable wheels positioned on an under surface of the base for allowing the compact disc packaging machine to be easily transported.

8. The compact disc packaging machine of claim 1, wherein the compact disc tray magazine is a vertical magazine positioned in a front of the machine.

9. The compact disc packaging machine of claim 1, further comprising indicator lamps for indicating the status of operations.

10. The compact disc packaging machine of claim 9, wherein the indicator lamps further comprises red, yellow, and green indicators positioned in a front of the machine.

11. The compact disc packaging machine of claim 1, further comprising a feeder band for feeding stacked covers to an intermediate position and further comprising a two-piece feeder for connecting a cover to a two-piece box base.

12. The compact disc packaging machine of claim 1, wherein the stacker for removing packaged compact disc boxes includes one of the following: an accumulator for storing filled compact disc boxes, a hopper for collecting filled compact disc boxes or a chute to deliver the compact disc packages to a desired location.

13. The compact disc packaging machine of claim 1, wherein the compact disc packaging machine uses pneumatics for less than 15 percent of machine functions and wherein the functions using pneumatics are loading functions.

14. The compact disc packaging machine of claim 1, wherein the overall floor space occupied by the machine is less than 2.0 meters by 2.5 meters.

15. The compact disc packaging machine of claim 1, wherein the magazine for holding and supplying compact discs is a turret magazine having multiple rotatable spindles positioned in a front of the machine and wherein one spindle is an active spindle allowing a stack of compact discs on that spindle to be unloaded while the other spindle is an inactive spindle that can be replaced by a new spindle having a fresh stack of compact discs.

16. The compact disc packaging machine of claim 15, wherein pneumatic cylinder-driven pushers feed the compact discs from a needle to a conical pin for eliminating positioning inaccuracies caused by variations in the verticality of the spindles.

17. The compact disc packaging machine of claim 15, wherein the pick-and-place mechanism further comprises an overhead swing frame having multiple interconnected vertical support pick-and-place parallel swing arms which are vertically and horizontally driven from the motor by gears, oscillators, cranks and links for performing unstacking and loading functions and by gears, pulleys, belts, and shafts for performing indexing, closing and accumulating functions.

18. The compact disc packaging machine of claim 17, wherein the multiple interconnected vertical support pick-and-place parallel swing arms further comprise a first pick-and-place pick-up head for moving an inlay card from the inlay card holder to a first intermediate centering position and then placing the inlay card from the centering position into a base of a compact disc box, a second pick-and-place pick-up head for moving a booklet from the booklet feeder to a second intermediate centering position and then moving the booklet from the second intermediate position into a cover of the compact disc box, a third pick-and place parallel pick-up head for moving a tray from the tray magazine to a third intermediate centering position and then moving the tray from the third intermediate centering position into the base of the compact disc box over the inlay card, and a fourth pick-and-place parallel pick-up head for moving a compact disc from the active spindle of the turret magazine to a fourth intermediate centering position and then moving the compact disc on a rosette of the tray installed in the box.

19. The compact disc packaging machine of claim 17, wherein the motor drives a transmission and wherein the transmission has outputs to oscillators, a first pulley, and at least one pulley plus a lever.

20. The compact disc packaging machine of claim 19, wherein the oscillators further comprise a first oscillator and a second oscillator positioned on an opposite side of the transmission from the first oscillator, wherein the first oscillator lifts and lowers a first link and the second oscillator lifts and lowers a second link, and wherein the first link rocks a first T-shaped bell crank about a first shaft and the second links rocks a second T-shaped bell cranks about a second shaft.

21. The compact disc packaging machine of claim 20, wherein the first and second T-shaped bell cranks raise and lower the overhead swing frame having multiple interconnected vertical support pick-and-place parallel swing arms.

22. The compact disc packaging machine of claim 19, wherein the first pulley is drivingly connected to a first toothed belt, wherein the first toothed belt is also drivingly connected to a second pulley, wherein the pulley plus a lever is drivingly connected to a second toothed belt, and wherein the second toothed belt is drivingly connected to a third pulley.

23. The compact disc packaging machine of claim 22, wherein the third pulley is drivingly connected to a third shaft for controlling feeder operations, wherein the second pulley is drivingly connected to a direction changer, wherein the direction changer is drivingly connected to a third toothed belt and a fourth pulley, and wherein the second pulley and third pulley perform indexing operations which move the compact disc boxes in a machine direction and which unstack the compact disc boxes, inlay cards and trays.

24. The compact disc packaging machine of claim 19, wherein the at least one pulley plus a lever further comprises a first pulley plus a lever and a second pulley plus a lever positioned on an opposite side of the transmission from the first pulley plus a lever, wherein the first pulley plus a lever is drivingly connected to a first lower link and the second pulley plus a lever is drivingly connected to a second lower link.

25. The compact disc packaging machine of claim 24, further comprising a first beam connected to a lower end of a first rocking support and a second beam connected to a lower end of a second rocking support, and wherein the first and second lower links drive the first and the second outer rocking supports respectively.

26. The compact disc packaging machine of claim 25, wherein the first lower link moves the first beam inward and outward while the first upper link lifts and lowers the first beam in proper sequence and wherein the second lower link moves the second beam inward and outward while the second upper link lifts and lowers the second beam in proper sequence.

27. The compact disc packaging machine of claim 19, wherein the motor further comprises a sealed kinematic box for reducing wear points and consequently maintenance costs.

28. A compact disc packaging apparatus comprising a first station for inserting a container having a base and a cover connected to the base and for opening the container, a second station having a first side for picking an inlay card, folding the inlay card and positioning the inlay card in the base of the container and having a second side for picking a booklet and positioning the booklet in the cover of the container, a third station having at least one sensor for sensing positions and orientations of the booklet in the cover and the inlay card in the base, a fourth station for picking a tray and loading the tray into the base of the container, a fifth station for picking a compact disc from a disc stack and for positioning the compact disc on the tray, a sixth station for closing the cover over the base of the container such that the cover overlies the booklet, the compact disc, the tray, the inlay card and the base, a seventh station for rotating the closed container on end and for pushing the closed container, and a drive mechanism for moving the container in steps between successive stations and for picking, inserting and relatively positioning the container, booklet, inlay card, tray and compact disc, and for closing and pushing compact disc loaded containers and plural mechanically operable actuators for operating each of the stations.

29. The apparatus of claim 28, wherein the drive mechanism further comprises a motor, a multiple output transmission connected to the motor, the transmission having first, second and third outputs, oscillators drivingly connected to the first outputs of the transmission, upper pulleys drivingly connected to the second outputs of the transmission, and lower pulleys drivingly connected to the third outputs of the transmission.

30. The apparatus of claim 29, further comprising first upper links having first ends connected to the first oscillators and second ends connected to first T-shaped bell cranks, second upper links connected between a top end of the first T-shaped bell cranks and a top end of second T-shaped bell cranks for rocking the second T-shaped bell cranks in unison with the first T-shaped bell cranks, rocking supports connected at upper ends to a lower end of the T-shaped bell cranks and connected at lower ends to lower links, and beams connecting the lower ends of the rocking supports, wherein the lower links move the beams inward and outward with the upper links lift and lower the beams in proper sequence.

31. The apparatus of claim 30, further comprising a first toothed belt drivingly connected to the lower pulleys, second lower pulleys drivingly connected to the first toothed belt, and a second toothed belt drivingly connected to the upper pulleys, third lower pulleys drivingly connected to the second toothed belt, a lower shaft drivingly connected to the third lower pulley for controlling feeder operations, a direction changer drivingly connected to the second lower pulleys, a third toothed belt drivingly connected to the direction changer, and a fourth pulley drivingly connected to the third toothed belt.

32. The apparatus of claim 28, wherein the disc holder further comprises a turret and multiple spindles rotatably mounted on the turret.

33. The apparatus of claim 28, wherein the first station further comprises a magazine for holding a stack of multiple containers, at least one sensor for checking orientations of the containers in the magazine, and a pickup head for indexing a bottom container from the stack and for rotating the cover of the container to a full open position.

34. The apparatus of claim 28, wherein the drive mechanism further comprises a pneumatic plant for providing the proper vacuum for lifting the inlay cards, booklets, trays and compact discs.

35. The apparatus of claim 28, wherein the motor further comprises a sealed kinematic box for reducing the number of wear points and consequently maintenance costs.

36. The apparatus of claim 28, wherein pneumatic cylinder-driven pushers feed the compact discs from a needle to a conical pin for eliminating positioning inaccuracies caused by variations in the verticality of the spindles.

37. The apparatus of claim 28, wherein the second station further comprises a motor-driven belt for bringing a booklet to a booklet transfer location where the booklet is placed upon the an intermediate centering device.

38. The apparatus of claim 28, further comprising a housing having a base and cover and wherein an electric panel for controlling the apparatus is built into the base of the machine.

39. The apparatus of claim 38, wherein the base further comprising retractable wheels connected to a lower surface of the base for allowing the apparatus to be easily transported and wherein the cover is transparent.

40. The apparatus of claim 28, further comprising an indicator lamp for indicating the status of operations.

41. The apparatus of claim 40, wherein the indicator lamp further comprises a red, a yellow, and a green indicator positioned in a front of the machine.

42. The apparatus of claim 28, further comprising a means for removing closed compact disc containers and wherein the means for removing closed compact disc containers includes one of the following means an accumulator for storing filled compact disc boxes, a hopper for collecting filled compact disc boxes, or a chute to deliver the compact disc packages to a desired location.

43. A method for packaging compact discs in compact disc containers comprising the steps of providing a stack of compact discs, providing a stack of compact disc containers having a cover and a base, selecting a compact disc container, rotating the cover of the container to a full open position using a compact disc box opening mechanism, providing a stack of inlay cards, picking an inlay card from the stack of inlay cards, transferring the inlay card to an intermediate pre-folding and locating fixture, folding the inlay card, inserting the inlay card into the base of the container, providing a stack of booklets, picking a booklet from the stack of booklets, transferring the booklet to an intermediate centering fixture, inserting a booklet into the cover of the container, sensing the presence and position of the inlay card, sensing the presence and position of the booklet, providing a stack of trays, selecting a tray from the stack of trays, transferring the tray to an intermediate stage, inserting the tray into the container, sensing the presence and position of the tray in the container, picking a compact disc from the stack of compact discs, positioning the compact disc in an intermediate fixture, moving the compact disc from the intermediate fixture on to the tray positioned in the container, sensing the presence and position of the compact disc into the compact disc box, and accumulating the compact disc boxes and performing each of the steps by plural mechanically operable actuators.

44. The method of claim 43, wherein the step of providing a stack of compact discs further comprises the step of removing an empty spindle from a compact disc magazine and replacing the empty spindle with a full spindle while a second spindle is in an infeed position.

45. The method of claim 43, wherein the step of picking up a compact disc from the spindle in the compact disc magazine and the step of moving the compact disc onto the compact disc tray are accomplished using a dual vacuum pick-up head.

46. The method of claim 43, further comprising the step of closing the compact disc cover.

47. The method of claim 43, wherein the step of unloading the closed compact disc boxes further comprises either providing a stack for gathering quality control samples or incomplete assemblies, providing a collection table for gathering containers in stacks, and providing a conveyor outfeed connected to a second machine.

48. The method of claim 47, further comprising the step of inserting coupons or special offer cards into the compact disc boxes.

49. The method of claim 47, further comprising the step of providing an additional external machine group wherein the external machine group inserts a second compact disc into the bottom of the tray before the tray is manually inserted into the compact disc tray magazine and further comprising the step of verifying the placement of the second disc on the compact disc tray.

50. The method of claim 47, further comprising the step of providing an additional special group for feeding, folding and inserting a "J" card into the cover of the container and further comprising the step of verifying the placement of the "J" card in the cover of the container.

* * * * *